US007311211B2

(12) United States Patent
Chung

(10) Patent No.: US 7,311,211 B2
(45) Date of Patent: Dec. 25, 2007

(54) STOCK SHELVING SYSTEM

(75) Inventor: Steve Chung, Kelowna (CA)

(73) Assignee: Custom Shelving Solutions Ltd., Kelowna (CA)

( * ) Notice: Subject to any disclaimer, the term of this patent is extended or adjusted under 35 U.S.C. 154(b) by 319 days.

(21) Appl. No.: 11/194,666

(22) Filed: Aug. 2, 2005

(65) Prior Publication Data

US 2005/0263465 A1 Dec. 1, 2005

Related U.S. Application Data

(63) Continuation-in-part of application No. 10/658,284, filed on Sep. 10, 2003, now abandoned.

(60) Provisional application No. 60/454,600, filed on Mar. 17, 2003.

(51) Int. Cl.
*A47F 5/08* (2006.01)

(52) U.S. Cl. ..... 211/90.02; 211/103; 211/192

(58) Field of Classification Search ..... 211/90.02, 211/193, 103, 175, 207, 208, 134, 187, 126.15, 211/106, 192, 186, 191, 59.2; 312/334.1, 312/334.5; 108/137, 143, 65, 144.11, 147.11–147.17
See application file for complete search history.

(56) References Cited

U.S. PATENT DOCUMENTS

| | | | | |
|---|---|---|---|---|
| 1,702,937 | A * | 2/1929 | Friedemann | 248/243 |
| 3,463,433 | A * | 8/1969 | Coe et al. | 248/242 |
| 4,620,489 | A | 11/1986 | Albano | |
| 5,123,546 | A * | 6/1992 | Crum | 211/59.3 |
| 5,185,971 | A | 2/1993 | Johnson, Jr. | |
| 5,487,525 | A | 1/1996 | Drabczyk et al. | |
| 5,673,801 | A * | 10/1997 | Markson | 211/59.3 |
| 5,720,230 | A | 2/1998 | Mansfield | |
| 5,738,019 | A * | 4/1998 | Parker | 108/108 |
| 5,855,283 | A * | 1/1999 | Johnson | 211/59.3 |
| 6,021,908 | A | 2/2000 | Mathews | |
| 6,364,136 | B1 | 4/2002 | Weshler et al. | |
| 6,375,015 | B1 | 4/2002 | Wingate | |
| 6,497,185 | B1 | 12/2002 | Barrett et al. | |

* cited by examiner

*Primary Examiner*—Jennifer E. Novosad
(74) *Attorney, Agent, or Firm*—Anthony C. Edwards

(57) ABSTRACT

Shelves are mounted on a pair of slides, and the slides mounted to a pair of mounting brackets, themselves mountable to a pair of standards. The shelves pull out on the slides, away from the standards. The distance between the pair of slides may be adjusted. A pair of opposed facing tangs are mounted on the base end of each mounting bracket. Each pair of tangs are adjustable to clamp into slots in the corresponding standard.

11 Claims, 16 Drawing Sheets

STOCK SHELVING SYSTEM

CROSS REFERENCE TO RELATED APPLICATION

This application is a Continuation-in-Part of U.S. patent application Ser. No. 10/658,284 filed Sep. 10, 2003 now abandoned, which claims priority from U.S. Provisional Patent Application No. 60/454,600 filed Mar. 17, 2003, entitled Stock Shelving System.

FIELD OF THE INVENTION

This invention relates to the field of shelving generally and in particular to an adjustable slide-out shelving system for retail stores having high stock turnover such as retail grocery stores, pharmacies and the like.

BACKGROUND OF THE INVENTION

In retail stores, 80% of the product is sold from 20% of the store. For example, a store with ten aisles will have two of those aisles producing 80% of the store total sales. These sections are known as high traffic areas. Because 80% of the stores' sales originate from the high traffic area, 80% of the stocking costs are spent replenishing 20% of the store. With any business, inventory control is a key ingredient in deriving profits from operations. Pharmacies and other retailers of consumable products must ensure that their inventory is properly rotated (old inventory sold before new inventory) each time the shelf is stocked.

Conventional shelving units seen in the retail market typically comprise a flat board used as a shelf, brackets with tangs, and vertical supports or standards. The bracket tangs are inserted into slots in the vertical supports, and the flat board typically rests on these brackets. Conventional standards are manufactured by Lozier™ (see FIG. 1), Husman™ (see FIG. 2), and Tyler™ (see FIG. 3). The prior art also contains designs and systems for sliding, extensible or slide-out shelves and drawers, and in this regard applicant is aware of the following U.S. Pat. Nos. 5,720,230; 6,021,908; 6,497,185; 6,364,136; 6,375,015; 5,487,525; and 4,620,489.

It is one object of the present invention to provide for the interchangeability of shelves and tangs with standards regardless of the spacing of the standards or the location of the apertures or slots in the standards.

SUMMARY OF THE INVENTION

The shelving system of the present invention provides an adjustable slide-out shelf for shopkeepers so as to improve the ergonomics of the restocking process, reduce labour and time, and to provide for easier inventory counts, and better quality control. These combined advantages reduce operating costs.

The adjustable slide-out stock shelving system of the present invention makes the re-stocking process more efficient by removing the step of having to take the old product off the conventional fixed shelf and placing it on the floor, only to have to return it back onto the shelf once the new product is loaded onto the rear of the shelf. This also potentially reduces the amount of bending a worker has to perform. By eliminating the stage of having to put the old product on the floor and then putting it back after unpacking and placing the new product on the shelf, the shelving system of the present invention speeds up this otherwise laborious process.

The shelving system of the present invention mounts to existing shelving standards, saving the cost of a full replacement of both shelves and standards.

The present invention is both a novel hardware system for retrofitting slide-out shelves onto existing standards, and for improved modular shelf construction, and is also a novel method. The method of the present invention is for installing and operating selectively extendable and retractable pullout shelves constructed according to the present invention. Each of the shelves may include:

(a) a substantially planar shelf which may be modularly constructed to adjust its depth and to provide curved or flat front edges; and, (b) mounted to the shelf, at and beneath longitudinally opposite ends of the shelf, so as to be disposed substantially entirely beneath the opposite ends of the shelf, an opposed pair of drawer runners or slides (hereinafter slides) extending across the ends of the shelf for selective translation of the shelf from a retracted position adjacent a corresponding pair of shelving standards, to which are mounted the pair of drawer slides on mounting brackets, to an extended position extended cantilevered from the pair of shelving standards on the pair of drawer slides wherein at least one of the slides is slidably mounted to the underside of the shelf for sliding adjustment longitudinally along the underside of the shelf;

(c) one or more pairs of vertically adjustable hooked-tang keys mounted to the ends of the brackets adjacent the standards wherein each pair of keys are vertically spaced apart relative to each other and selectively adjustable to selectively vary the spacing between the keys in each pair of keys, the keys and slides thus adjustable to align the tangs on the keys with existed mounting slots in the columns of the standards.

Further advantageously the pullout shelves of the present invention are mountable to the shelving standard in closely spaced array, side-by-side between adjacent standards.

In summary the present invention according to one aspect is a shelving system for mounting to at least one pair of parallel, substantially vertical, laterally spaced apart shelving standards, where the standards are laterally spaced apart a first distance. The system includes:

a) at least two pairs of keys, each pair of keys of said two pairs of keys having vertically spaced apart opposed facing upper and lower keys having opposed facing tangs, that is a downwardly inclined tang extending cantilevered from the upper key and an upwardly inclined tang extending cantilevered from the lower key in opposed facing relation to the downwardly inclined tang for releasably interlocking mating with corresponding vertically spaced apart slots in each stand column in the pair of standards;

b) at least one pair of rigid bracket arms mounted or mountable to the keys, each bracket arm mounted or mountable to a corresponding pair of vertically spaced keys, c) manually extendable slides, mounted or mountable to each bracket arm, translatable in a lateral direction between a retracted position and an extended position cantilevered from each bracket arm, d) a rigid substantially planar shelf mounted or mountable onto the slides, at opposite ends of the shelf, and so as to extend longitudinally between the slides when the slides are mounted to each pair of bracket arms and the bracket arms to the standards, wherein the shelf has a first length measured longitudinally from and between each end of the shelf, wherein at least one of the slides is slidably mounted to the corresponding end of the shelf for selectively adjustable sliding longitudinally relative to the shelf so as to adjust the longitudinal distance between the two pairs of keys, when mounted to the bracket arms, to correspond to the first distance when the first length is greater than the first distance.

A selectively actuable actuator such as a threaded member including a shaft or bolt may be provided which is mountable to each pair of vertically spaced keys for selectively engaging and tightening each opposed facing pair of tangs onto the corresponding standard when each pair of keys are mounted thereto. The actuator tightens the tangs into snug mating engagement in the corresponding slots in the standard and thereby increases the rigidity of the hooked mating of the tangs into the slots in the standards. In one embodiment the actuator includes a threaded member rotatably journalled through corresponding pairs of bores in the vertically spaced pairs of keys so that one key of each pair is threadably mounted to the threaded member where the elongate member is threadably mounted to that key by engaging threads in the corresponding bore for sliding translation of the threaded member relative to the key. The other key in each pair of keys may be rigidly mounted to the end of the mounting bracket and the threaded-bore key slidably mounted to the end of the mounting bracket so that turning the threaded member causes adjustment of the spacing between the upper and lower keys in each pair of keys.

The shelf may include modularly interlocking shelf members which are releasably mountable to one another. Thus a shelf depth perpendicular to the first length may be adjusted by removing or installing the shelf members from or onto the shelf respectively. The shelf members may also include a front member mountable at a distal end of the each pair of rigid bracket arms, distal to opposite ends of the each pair of rigid bracket arms mountable to the corresponding keys. The front member may include electronic merchandising means mounted within the front member.

In a further aspect, the method according to the present invention of mounting a shelving system according to the present invention includes the steps of:

a) providing a pair of parallel, substantially vertical, laterally spaced apart shelving standards laterally spaced apart a first distance;

b) providing at least two pairs of vertically spaced apart keys releasably mated with the pair of standards, one vertically spaced apart pair of keys per standard c) providing a pair of rigid bracket arms mounted to the pairs of keys, each bracket arm of the pair of rigid bracket arms mounted to a corresponding pair of vertically spaced apart keys, wherein at least one of the keys in each pair is a slidable key slidably mounted to the end of the bracket arm adjacent the corresponding standard for vertical sliding relative to the bracket arm, d) providing manually extendable slides, mounted to the each bracket arm, translatable between a retracted position and an extended position cantilevered from the each bracket arm, e) providing a rigid substantially planar shelf mounted onto the slides, at opposite ends of the shelf, and so as to extend between the slides when the slides are mounted to the pair of rigid bracket arms, wherein the shelf has a first length measured from each end of the opposite ends, f) providing a threaded member for each pair of keys threadably mounted thereto for actuating vertical sliding of the slidable key along the end of the bracket arm, g) adjusting the vertical distance between each pair of keys, when mounted to the pair of rigid bracket arms, to correspond to the vertical spacing between vertical spaced and vertically aligned slots in the standard and adjusting the horizontal distance between the pair of slides and corresponding pair of mounting brackets to correspond to the first distance, h) inserting the pairs of tangs corresponding to the pairs of keys into the corresponding slots in the standard and turning the threaded member so as to tighten the tangs in to snug mating engagement in the slots.

The method may also include the steps of:

(a) laterally translating in a first direction the shelf from the retracted position to the extended position, (b) laterally translating old product on the shelf in the first direction so as to abut and face the old product against a second or forward edge of the shelf opposite to the first or rearmost edge, (c) stock new product on the shelf behind the old product on the shelf so as to position the new product adjacent the old product between the old product and the rearmost edge of the shelf, (d) laterally translate the shelf in a second direction opposite to the first direction from the extended position to the retracted position.

The method may also include the step of providing flanges mounted to forward and/or rear edges of the shelf, where each flange extends vertically upwards.

DETAILED DESCRIPTION OF EMBODIMENTS OF THE INVENTION

Figure 1:
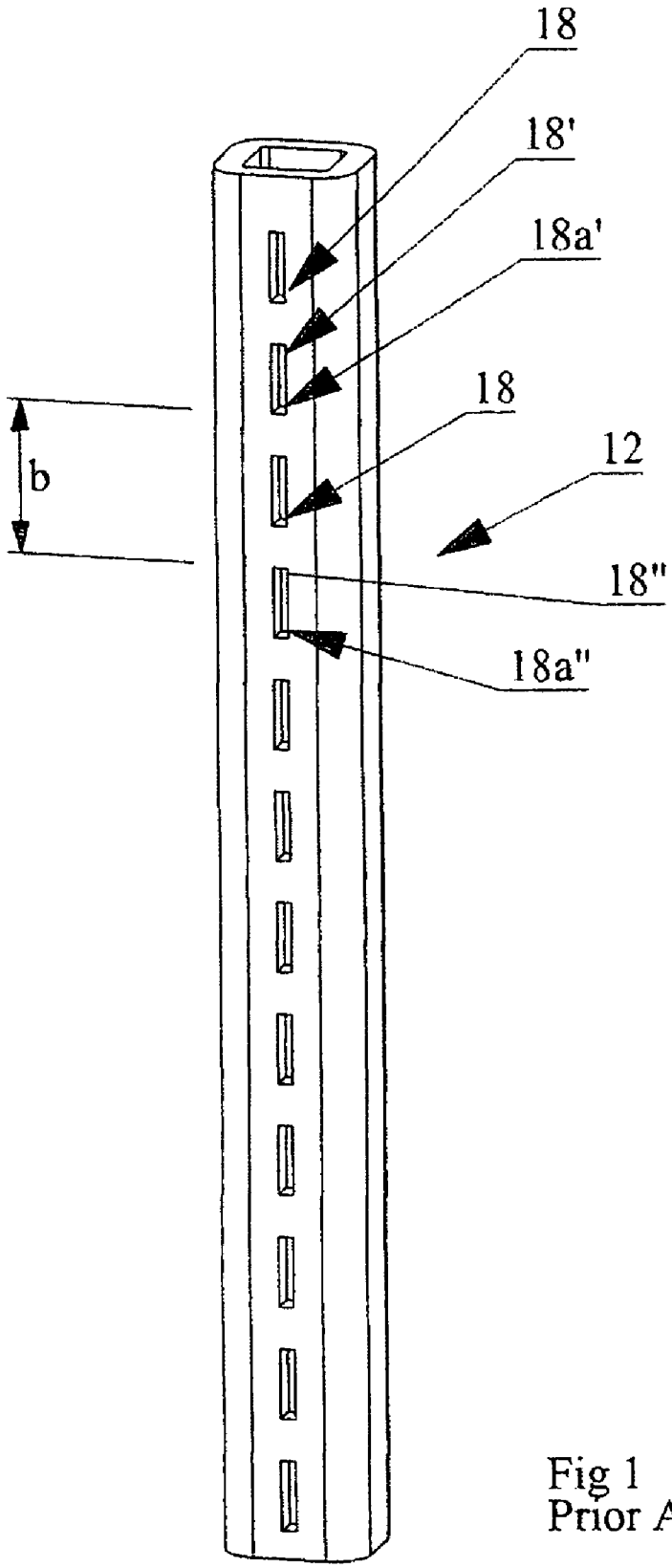
Fig 1 Prior Art
FIG. 1 is, in perspective view, a prior art shelving standard as manufactured by Lozier™.

The shelving system of the present invention streamlines the re-stocking process into five steps which follow onto how the stock on a shelf is typically left by consumers taking product from the shelf:

Step 1) Move new product to the vicinity of slide-out stock shelf 10 ready to be stocked onto shelf 10.

Step 2) Pull shelf 10 forward so as to cantilever shelf 10 from its support standard 12 thereby allowing easy access to the old product on the shelf.

Step 3) Move old product forward on the shelf, thereby facing the shelf at the same time.

Step 4) Place new product behind old product.

Step 5) Push shelf 10 back into place flush with other shelves.

With reference to the drawings wherein similar characters of reference denote corresponding parts in each view, the shelving system of the present invention includes one or more laterally translatable shelves 10. Herein, lateral translation refers to pulling out or pushing in a shelf on its slides and longitudinal refers to the direction of the longitudinal axis of the shelf. The shelves may be retro-fitted for mounting to a spaced apart pair of generally vertical and parallel standards. The shelves slide in and out between a pair of mounting brackets 14 supporting the shelf. Brackets 14 are cantilevered from the pair of standards. The sliding in and out of the shelves facilitates re-stocking of shelves 10 as old product on shelves 10 may be moved frontwards and new product placed rearwards on the shelves without necessitating the prior removal of old product from the shelves.

Each shelf 10 lies horizontally flat between the corresponding pair of mounting brackets 14. Mounting brackets 14 are mounted to a corresponding pair of drawer slides 16. Slides 16 are mounted under the oppositely disposed ends of shelf 10. Brackets 14 themselves mount to conventional shelving standards 12 by the use of a pair of keys 22. Keys 22 mate with apertures or slots 18 wherein elongate, T-shaped etc. (herein collectively referred to as slots) in standards 12. At least one of the slides 16 is adjustably mounted to the underside of shelf 10, for example by the use of bolts (not shown) engaging slots 24*a* in longitudinally extending beams 24 mounted under and along so as to support shelf 10 when under load. Slots 24*a* allow for the selective adjustment of the spacing between the pair of mounting brackets and corresponding pair of slides on opposite lateral ends of each shelf 10. Thus the spacing may be adjusted for different spacing between different pairs of standards 12, and allows for a retro-fit mating of shelves 10 onto pre-existing shelving standards 20 where the standard uprights have apertures or slots into which the key tangs 22*a* of keys 22 mate.

Keeping in mind that it is one object of the present invention to provide a single mounting bracket, slide and shelf design to provide a universal fit for existing standards such as found in conventional retail outlets, the sliding shelf must be capable of bearing a relatively heavy load when pulled outwardly on the slides so as to be fully cantilevered from the standards, without harming the standards due to the load. In particular, the bending moment applied to the standard at the adjacent end of the mounting bracket cannot be so great as to deform or tear the metal of the standard. If in one example the retail establishment is a grocery store, it would not be unusual to find one pound items such as a four hundred fifty gram container of sour cream, stacked four high, five deep, and ten wide, that is, ten along the length of shelf 10. These two hundred containers would thus weigh approximately two hundred pounds centered over shelf 10. Presuming that the product is being routinely faced against the forward edge of shelf 10 after product has been removed by consumers from the shelf, the center of gravity of the remaining product taken as a whole shifts from the longitudinal centreline of the shelf towards the forward edge. Thus if the center of gravity of product on shelf 10, when fully extended on slides 16, is cantilevered approximately two feet from standard 12, then when loaded with an evenly distributed two hundred pounds, the mounting brackets will exert a moment of approximately four hundred foot-pounds on standards 12, evenly distributed between the pair of mounting brackets, where the mounting brackets mate onto the corresponding pair of standards.

Figure 2:
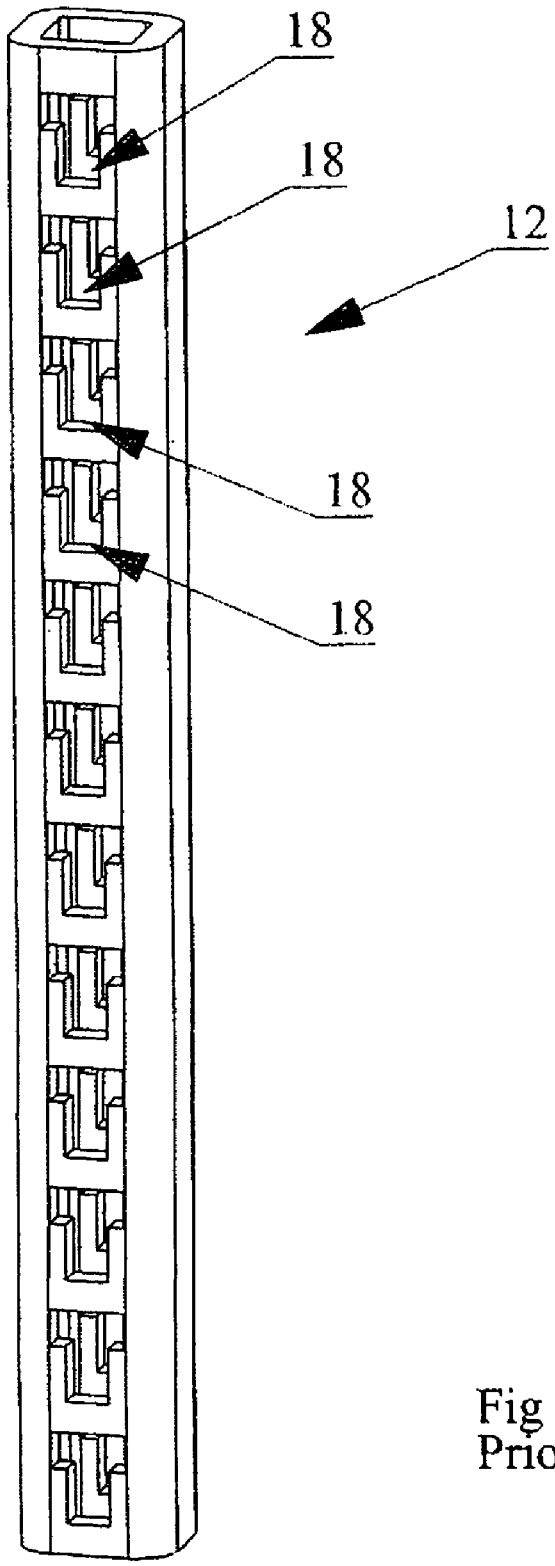
Fig 2 Prior Art
FIG. 2 is, in perspective view, a prior art shelving standard as manufactured by Hussman™.
Figure 3:
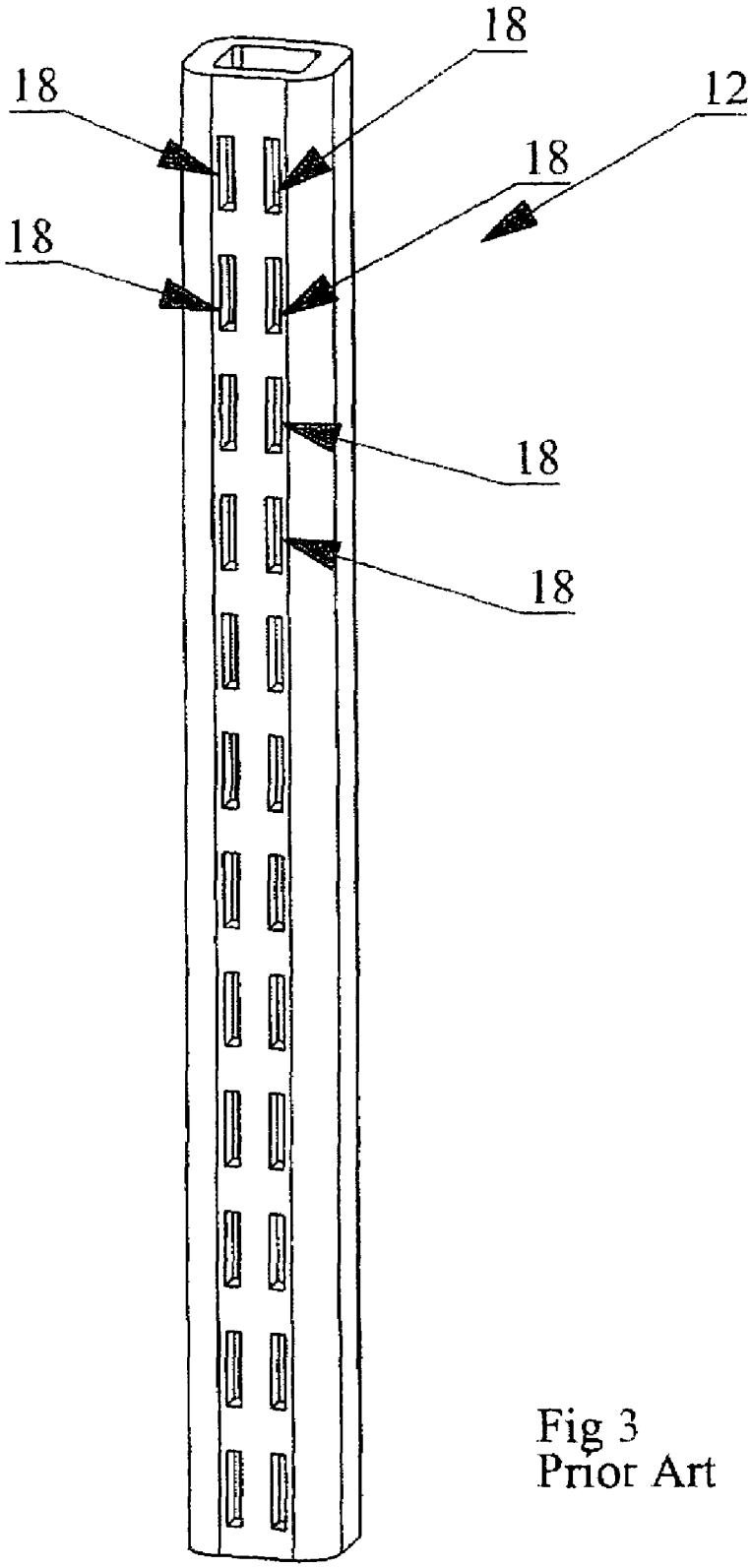
Fig 3 Prior Art
FIG. 3 is, in perspective view, a prior art shelving standard as manufactured by Tyler™.
Figure 4:
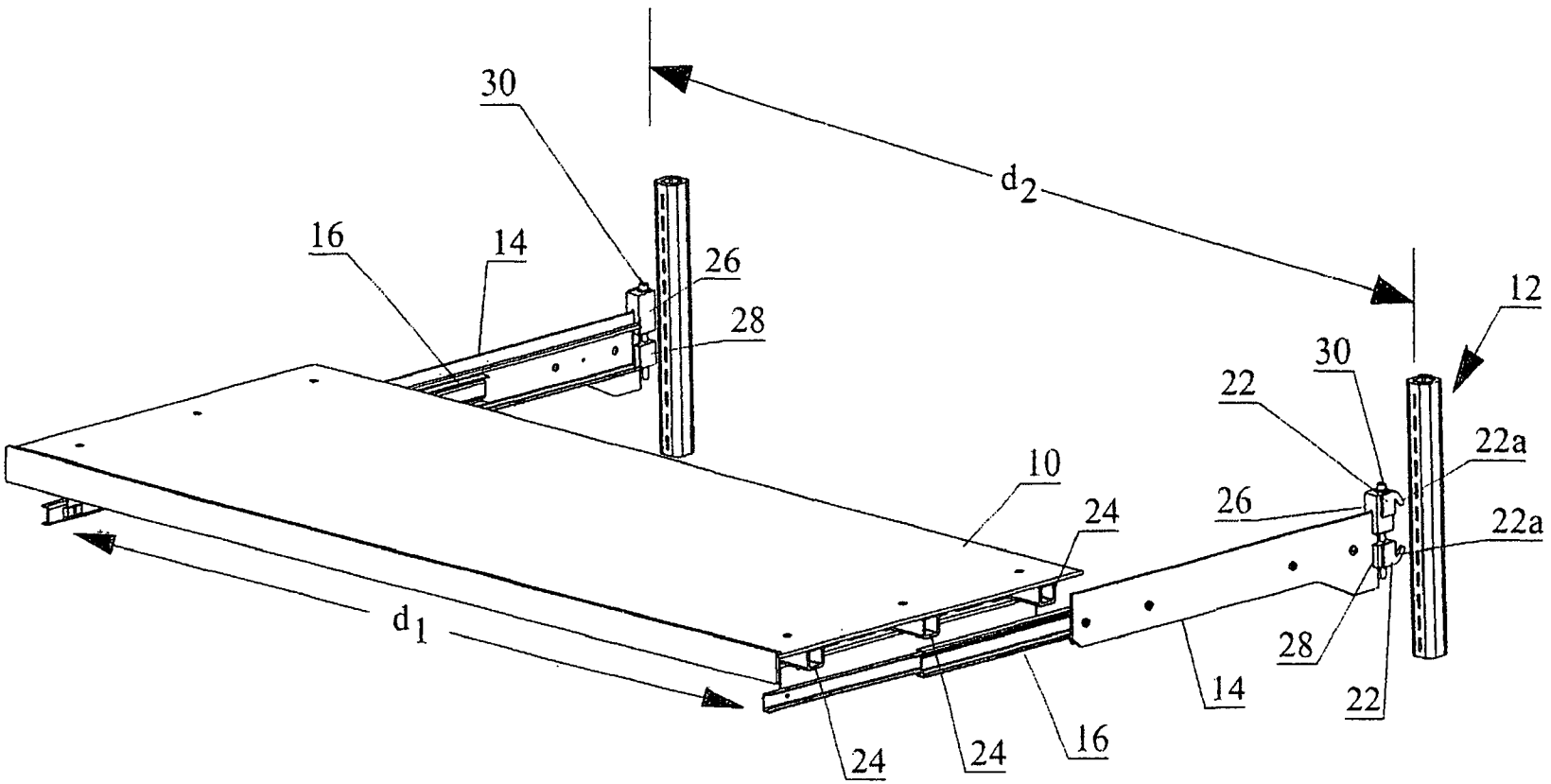
FIG. 4 is, in top perspective view, the shelving system according to the present invention shown mounting a Lozier standard, the shelf in the fully extended position.
Figure 5:
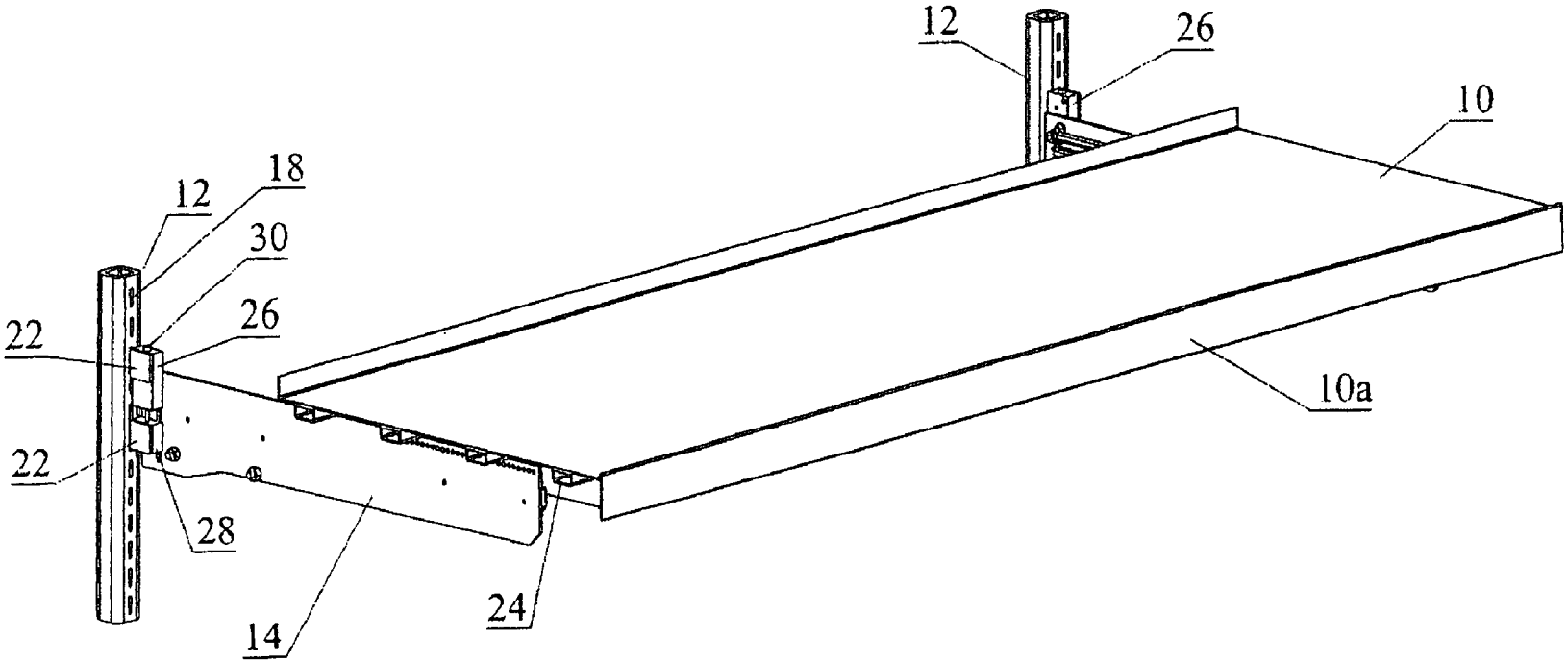
FIG. 5 is, in top perspective view, the shelving system according to the present invention mounted to a pair of Lozier standards, the shelf in the partially retracted position.
Figure 6:
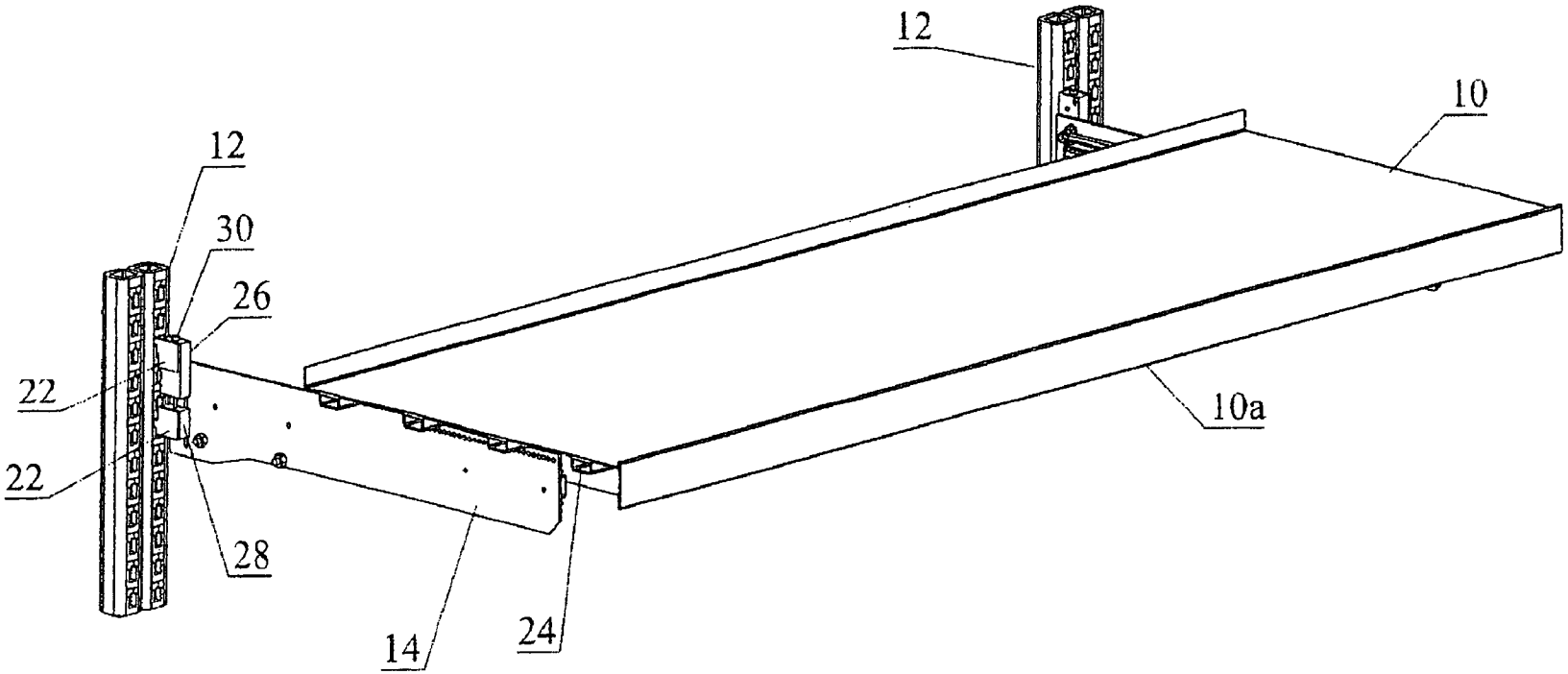
FIG. 6 is, in top perspective view, the shelving system according to the present invention mounted to a pair of Hussman standards.
Figure 7:
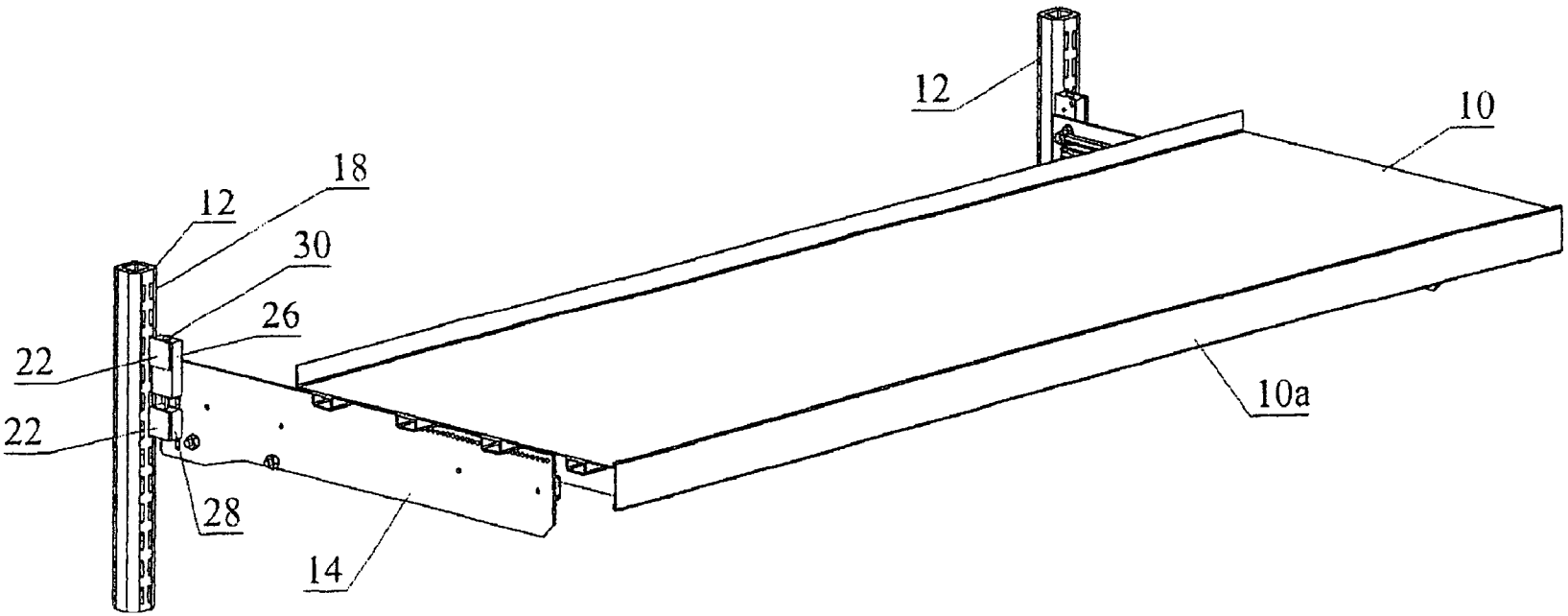
FIG. 7 is the shelving system according to the present invention mounted to a pair of Tyler standards.
Figure 8:
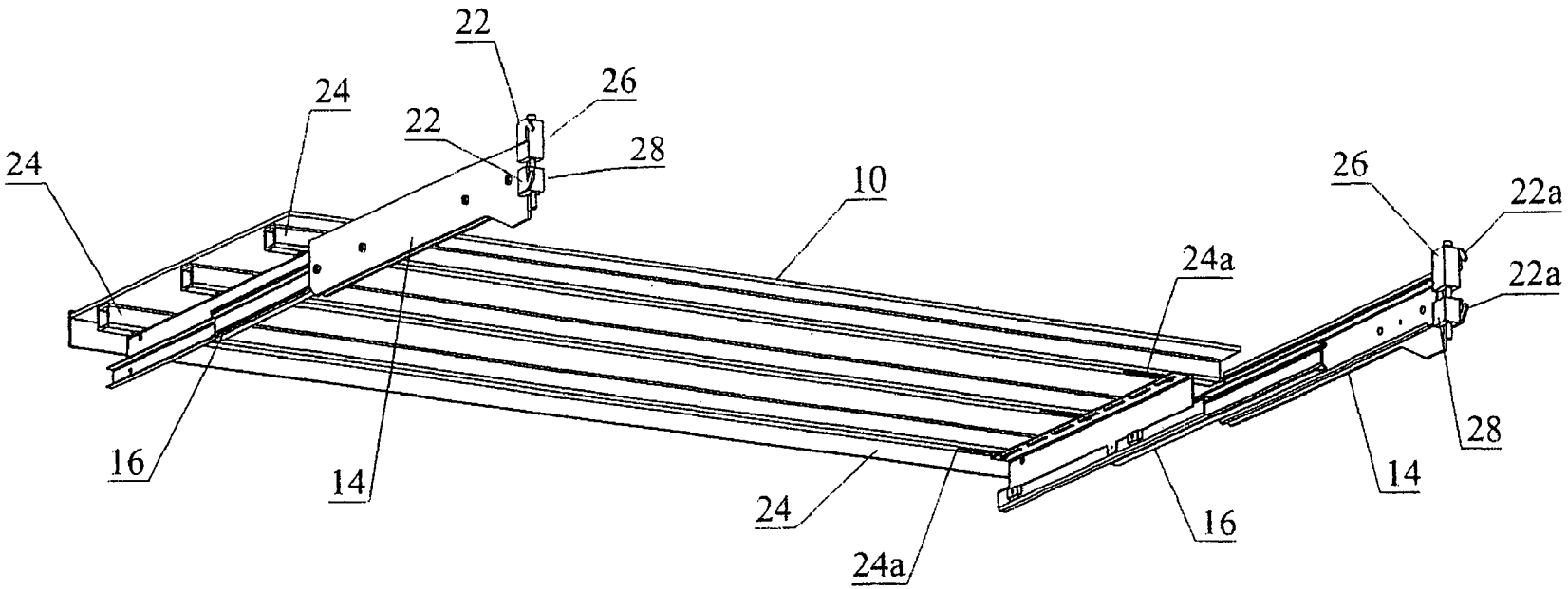
FIG. 8 is a right rear bottom perspective view of the shelving system of FIG. 4.
Figure 9:
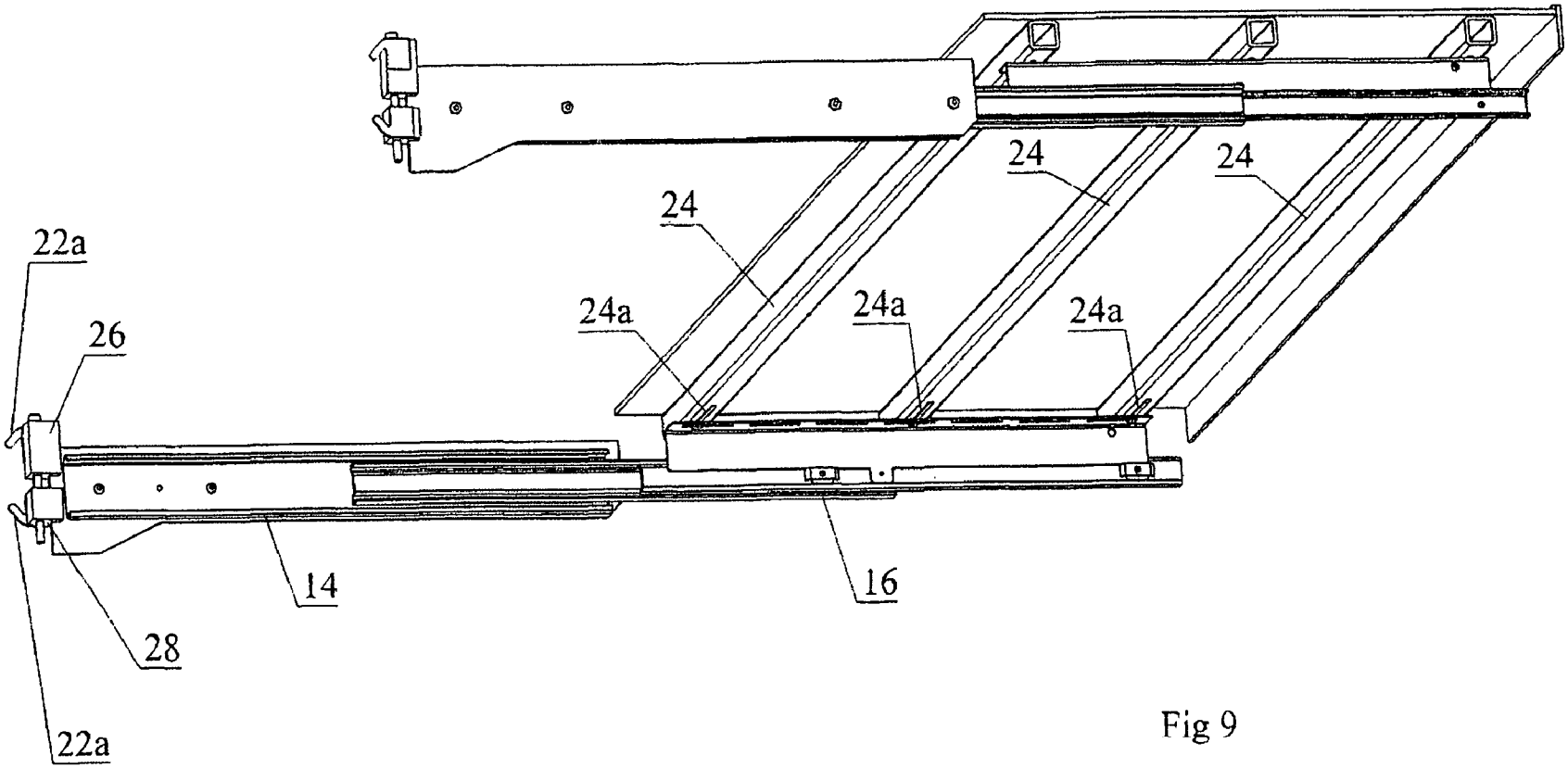
FIG. 9 is a left rear bottom perspective view of the shelving system of FIG. 8.
Figure 10:
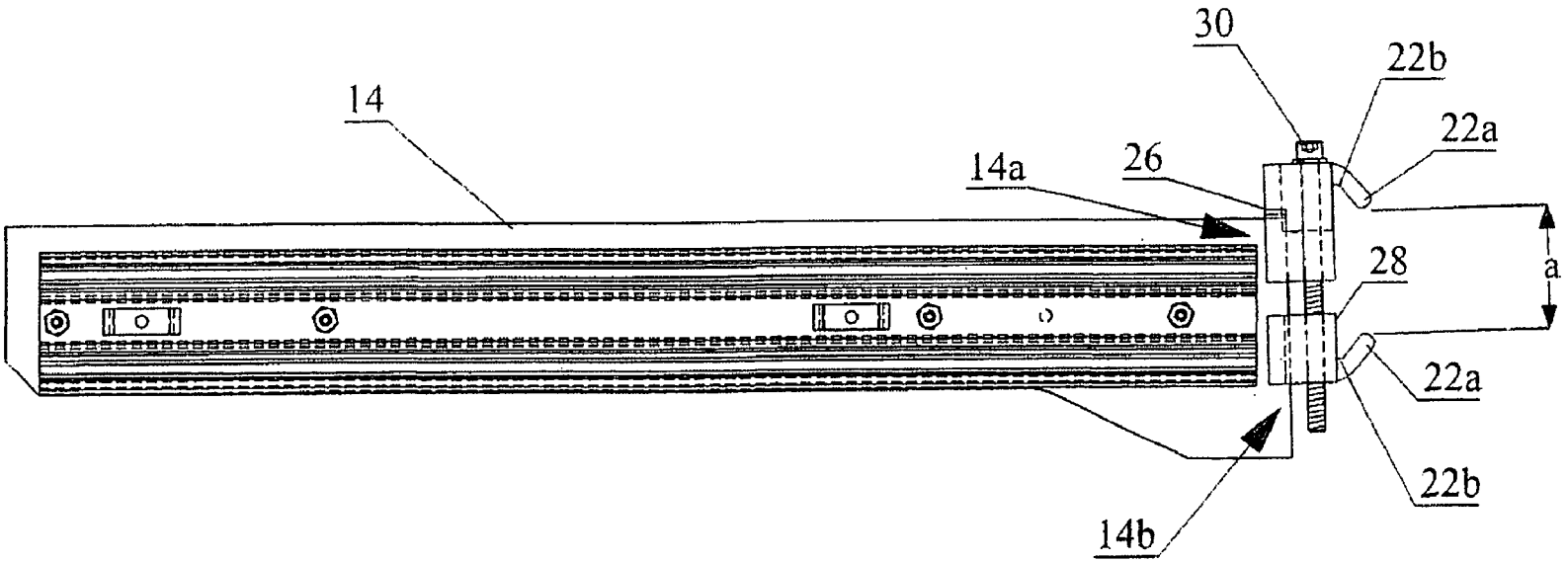
FIG. 10 is, in elevation view, a mounting bracket, slide and key clamp of the shelving system according to the present invention.
Figure 11:
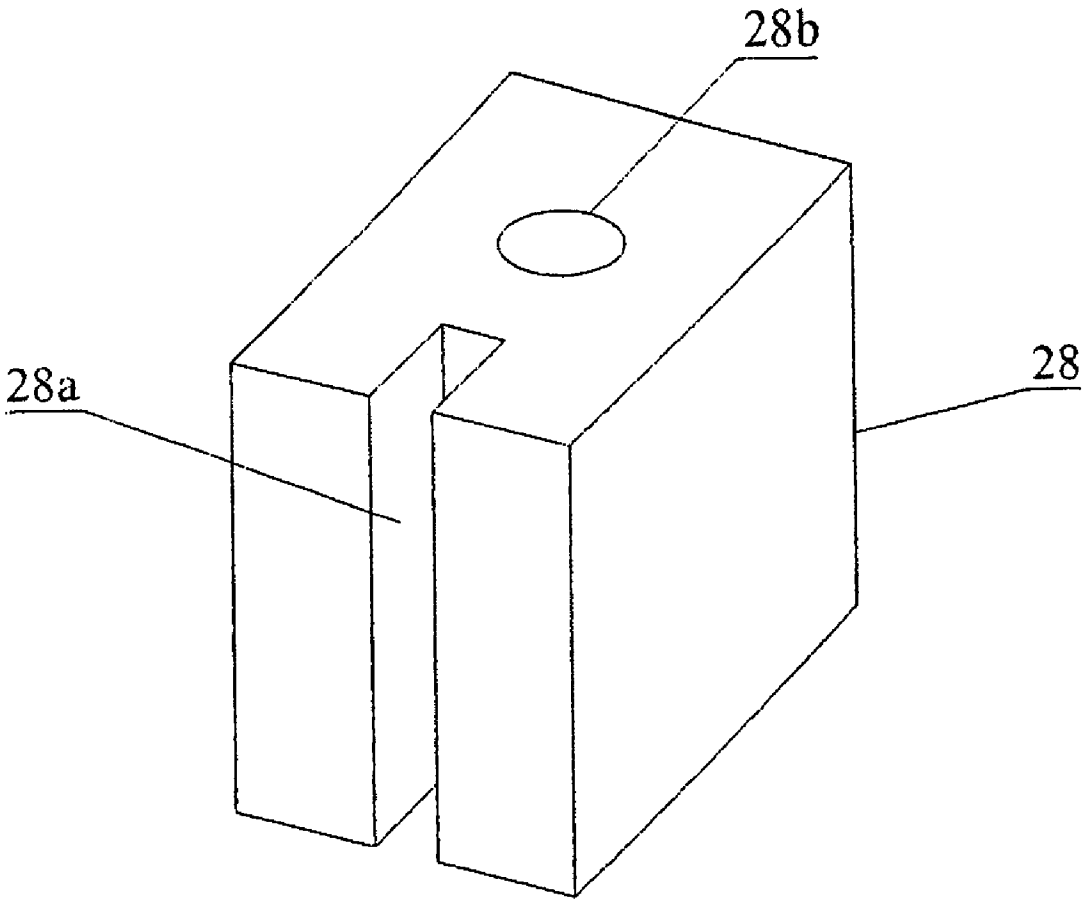
FIG. 11 is, in perspective view, an upper key block of the key clamp of FIG. 10.
Figure 12:
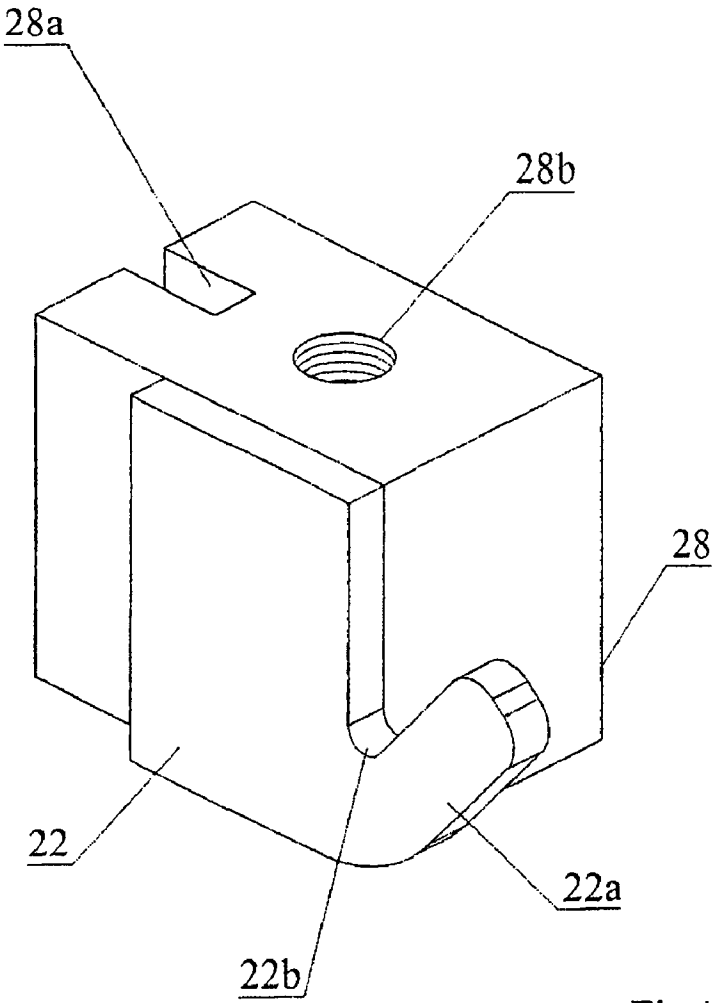
FIG. 12 is, in perspective view, a lower key slide of the key clamp of FIG. 10.
Figure 13:
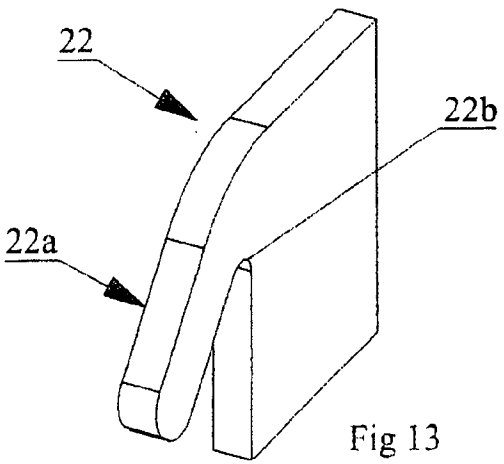
FIG. 13 is, in perspective view, a key of the key clamp of FIG. 10.
Figure 14:
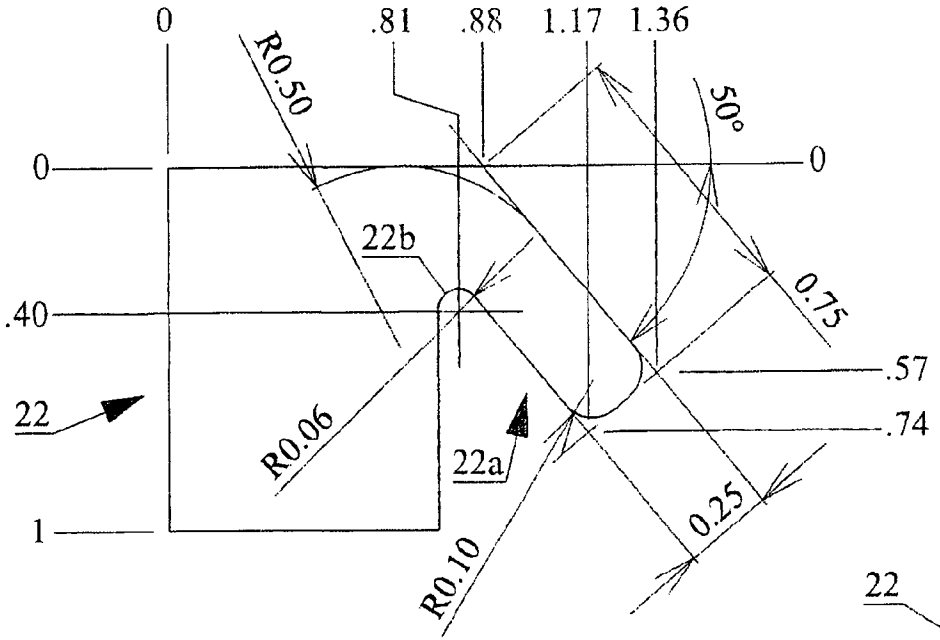
FIG. 14 is, in elevation view, the key of FIG. 13 illustrating typical dimensions.

As described above, keys 22 are mounted to the end of mounting brackets 14 adjacent standards 12 so as to engage tangs 22*a* extending from keys 22, into mating engagement in slots 18 in standards 12. Because it is desirable to have a single key and tang design fit most if not all existing standards, and in particular so that tangs 22*a* fit into most if not all existing slots 18 in those standards, tang 22*a* can be no larger than the smallest of slots 18. Thus for example if the height of slots 18 in the Hussman™ standard of FIG. 2 is one half inch and the height of slot 18 in the Lozier™ standard of FIG. 1 is three quarters of an inch, then a tang 22*a* must be able to fit into the smaller Hussman™ slot 18 as well as into the larger Lozier™ slot. Further, if the width of a slot 18 in the Lozier™ standard is three sixteenths of an inch, and the width of a slot 18 in the Tyler™ standard of FIG. 3 is one eighth of an inch, then again tangs 22*a* cannot be any wider than one eighth of an inch so as to fit into not only the Lozier™ but also the Tyler™ standards. This limits the surface area of each tang 22*a* which may be brought to bear on the corresponding load bearing surfaces in slots 18 of standards 12. By way of example, the dimensions of key 22 and tang 22*a* may be as set out in FIG. 14 wherein the linear dimensions are in inches and the angular dimensions are in degrees, and wherein, although not illustrated, all sharp edges on surfaces in contact with the surfaces of a slot 18, are slightly rounded or bevelled.

An upper key block and a lower key slide are mounted onto each mounting bracket 14. A vertically aligned pair of keys 22 are rigidly mounted onto upper key block 26 and lower key slide 28 respectively as by welding, bolting or the like. The keys are arranged so that tang 22*a* on the key 22 mounted to the upper key block 26 is inclined downwardly into opposed facing relation with an upwardly inclined tang 22*a* on the key 22 mounted to the lower key slide 28. Upper key block 26 has a channel 26*a* extending along the length of the block. Channel 26*a* is sized so as to snugly slide over the upper corner 14*a* of the base end of each of mounting brackets 14 so that upper key block 26 may be rigidly mounted thereto. Channel 26*a* extends vertically upwardly from the lower end of upper key block 26. Upper key block 26 also has a vertically extending bore 26*b* which extends the vertical length of upper key block 26. A bolt 30 having a non-threaded upper portion is fully journalled through bore 26*b* so as to reside slidably in bore 26*b*. Bolt 30 has a lower threaded portion which threadably engages a correspondingly threaded bore 28*b* in lower key slide 28.

Lower key slide 28 is also mounted to the base end of bracket 14 by means of a vertical channel 28*a*. Channel 28*a* extends the entire vertical height of key slide 28 so as to slidably mount key slide 28 onto the lower rear corners 14*b* of the base end of mounting bracket 14. Thus with a lower key slide 28 slidably mounted onto each mounting bracket 14 by slidably mounting lower rear corners 14*b* into sliding engagement in channels 28*a*, bore 28*b* on key slide 28 and bore 26*b* on key block 26 mounted to upper corners 14*a* are vertically aligned so as to receive bolt 30 journalled through the bores so that the lower threaded portion of bolt 30 threadably engages the threads in bore 28*b*.

Thus with bolt 30 journalled through bores 26*b* and 28*b*, turning bolt 30 selectively adjusts the vertical separation distance a between the ends of the opposed facing tangs 22*a*. In use then, bolt 30 is turned so as to adjust distance "a", for example, so as to be slightly greater than the spacing between two slots 18, shown as distance "b" in FIG. 1. With distance "a" so set, the opposed facing pair of tangs 22*a* on the corresponding pair of upper key block 26 and lower key slide 28 may be inserted into the corresponding slots 18, labelled 18' and 18" in FIG. 1. Tangs 22*a* are inserted fully into slots 18' and 18" and bolt 30 then turned so as to close distance "a" by retracting lower key slide 28 towards upper key block 26 until the tangs 22*a* are snugly mated with standard 12 by snugging shoulders 22*b* against the corresponding load bearing edges, respectively 18*a*' and 18*a*" of slots 18' and 18".

In the example illustrated, bolt 30 is approximately four inches long. It has been found that the greater the spacing between upper key block 26 and lower key slide 28, that is, the greater distance "a" when the upper key block and the lower key slide are mated to a standard 12, the greater the load bearing capacity of shelf 10 without deforming standard when shelf 10 is fully extended cantilevered outwardly on mounting brackets 14 and slides 16. Thus it was found that increasing the length of bolt 30 from approximately three inches to approximately four inches, increased the load bearing capacity approximately one hundred pounds, apparently because the longer bolt 30 allowed the upper key block and lower key slide to be mounted into a pair of slots 18 spaced further apart from one another, for example, into slots 18' and 18" leaving one slot 18 un-used therebetween. Using a four inch bolt, it was found that, with shelves 10 having a nominally two hundred fifty pound load capacity and extended fully away from the standards, the Hussman™ standards failed at approximately a two hundred thirty pound loading on shelf 10 and the Lozier™ standards failed at approximately a two hundred ninety pound loading on shelf 10.

In the embodiment illustrated, the head of bolt 30 is formed for mating with an allen key wrench. Other embodiments intended to be included within the scope of the present invention include the use of bolts 30 having thumb screw heads which allow for a manual turning of bolt 30 without the need for a wrench or other tools.

Figure 15:
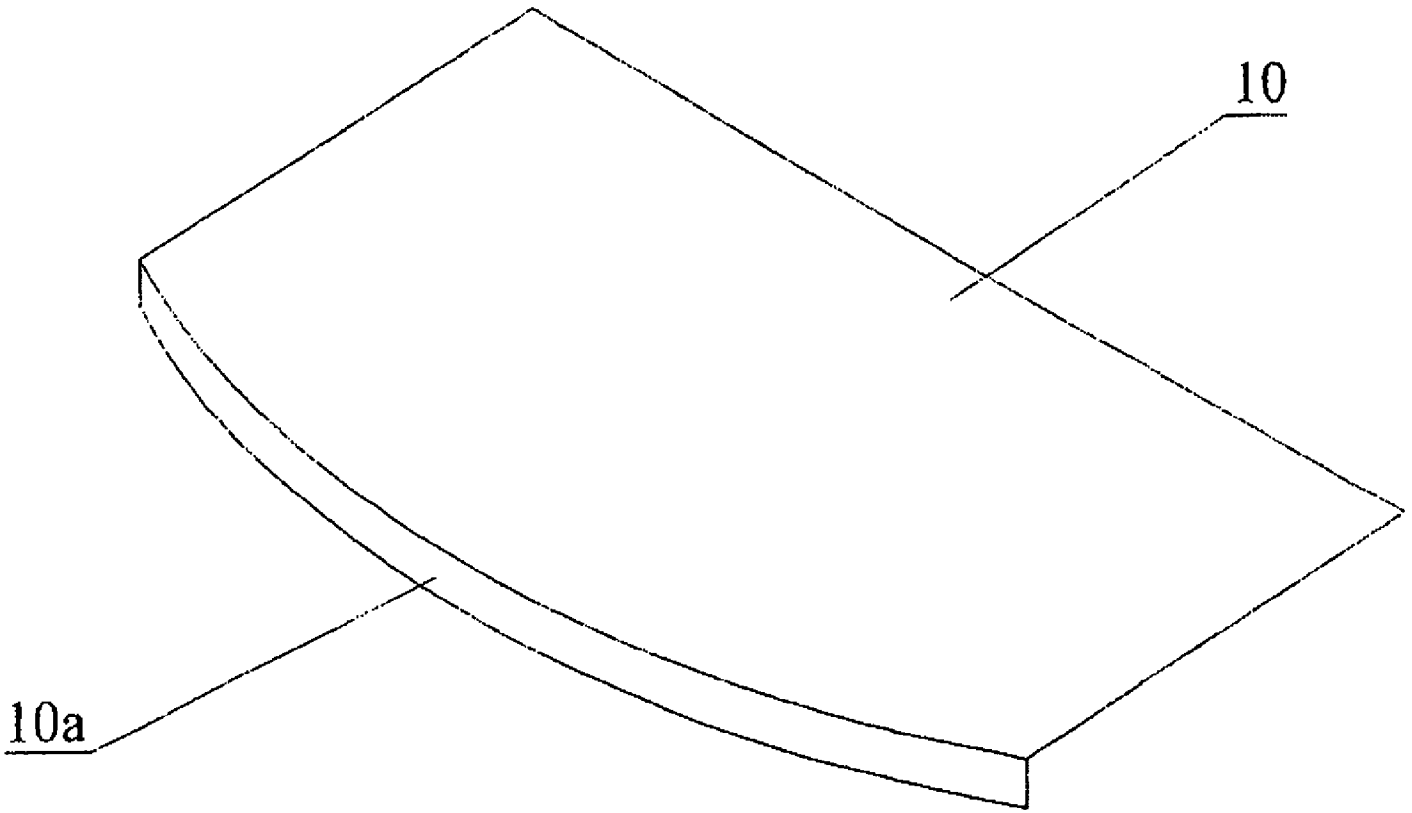
FIG. 15 is, in top perspective view, an alternative embodiment of the shelf according to the present invention with a rounded front.

As seen in FIG. 15, in one embodiment of the present invention, the front edge 10*a* of the shelf may be curved, which although illustrated as being a convex curvature, is not intended to be so limited, and is intended to merely illustrate that the front edge may be curvilinear including whether convex or concave.

Figure 16:
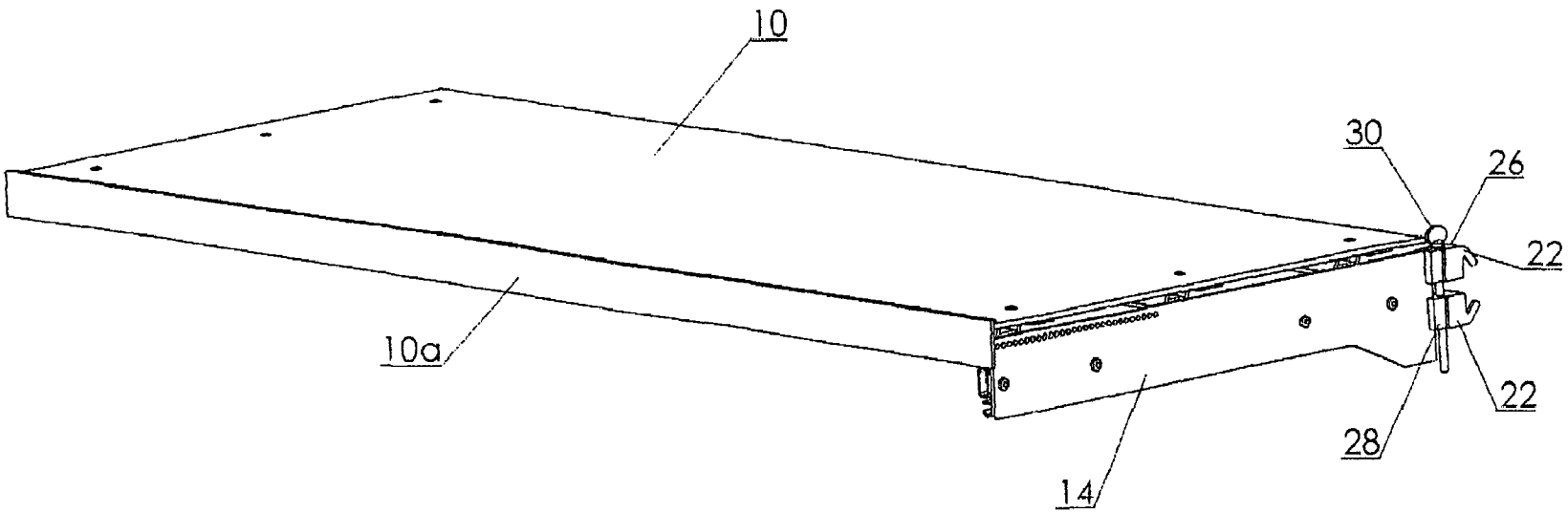
FIG. 16 is, in front top perspective view, a further embodiment of the shelving system according to the present invention.
Figure 17:
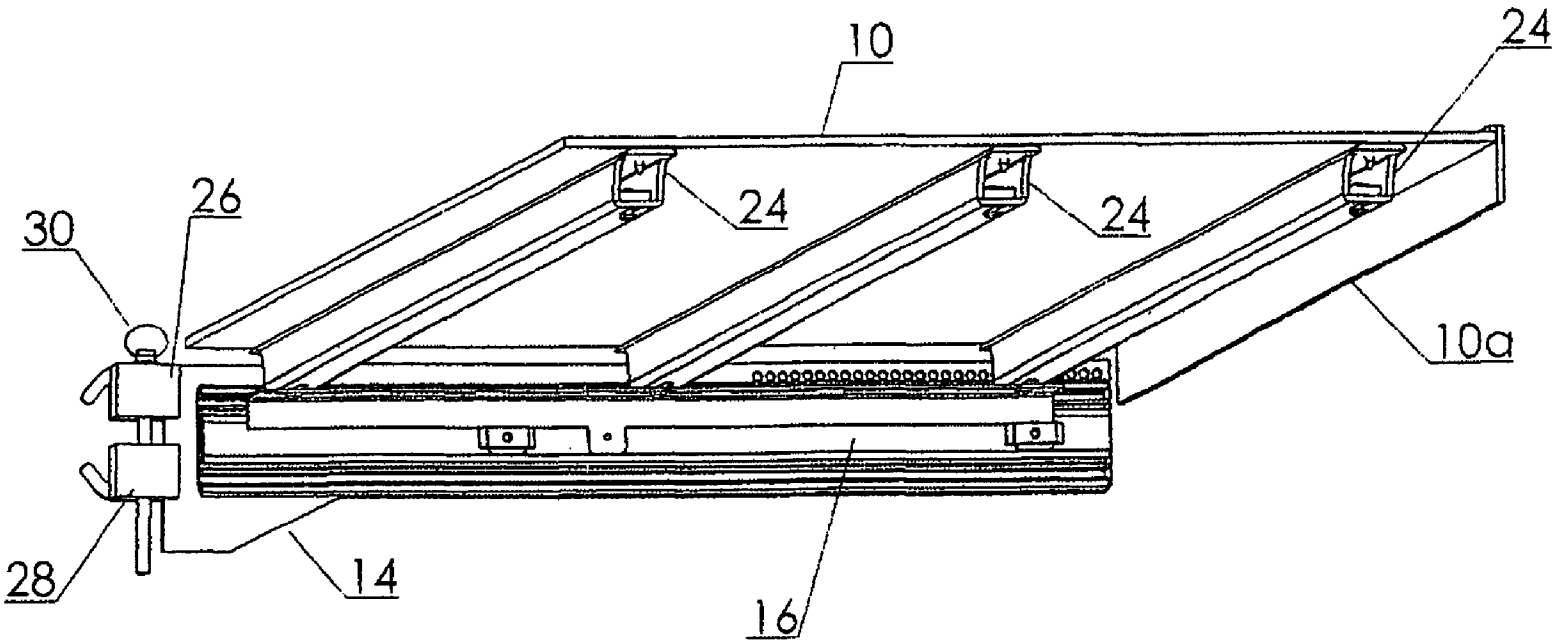
FIG. 17 is, in partially cut away bottom perspective view, the shelving system of FIG. 16.

In the embodiments of FIGS. 16 and 17, support beams 24 are notched at their ends so that shelf 10 may be mounted down flush onto the upper edges of mounting brackets 14.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A shelving system for mounting to a pair of parallel, substantially vertical, spaced apart shelving standards spaced apart a first distance, wherein each standard in the pair of standards has a vertically spaced apart array of slots, the shelving system comprising:

a) a pair of keys adapted for releasably interlocking mating to said each standard in said slots wherein said pair of keys includes first and second keys, wherein said first key is mounted to a key mount so as to dispose a first tang on said first key outwardly of said key mount, and wherein said second key is mounted on a slide block so as to dispose a second tang outwardly of said slide block, b) a pair of rigid bracket arms wherein each bracket arm of said pair of bracket arms has a base end and a cantilevered end, c) a pair of slides, wherein each slide of said pair of slides is mounted to one of said each bracket arms whereby said pair of slides are mounted to said pair of bracket arms for selective cantilevered extension of said pair of slides in a first direction from said cantilevered ends of said pair of bracket arms, d) a rigid shelf mounted atop of said pair of slides for extension on said pair of slides from said cantilevered end of said pair of bracket arms, wherein at least one slide of said pair of slides is removably mounted to adjustment means on an under side of said shelf for releasably lockable positioning of said at least one slide under said shelf in a horizontal second direction perpendicular to said first direction whereby a spacing between said pair of bracket arms may be selectively adjusted for retro-fit to said pair of standards, wherein said key mount is rigidly mounted to said base end of said each bracket arm and wherein said slide block is slidably mounted to said base end of said bracket arm so as to dispose said first and second tangs in opposed facing relation to each other and so as to dispose said first and second tangs outwardly of said base end of said bracket arm for engagement into a corresponding vertically spaced apart pair of slots in said vertically spaced apart array of slots in said each standard, and wherein a selectively actuable clamping member is mounted to said key mount and said slide block to selectively clamp said opposed facing pair of said first and second tangs towards each other to matingly engage said first and second tangs in said each standard behind said pair of slots.

2. The shelving system of claim 1 wherein said each bracket arm is planar and lies in a vertical plane and wherein said key mount is rigidly mounted to an upper edge of said base end and wherein said slide block is slidably mounted to an end edge of said base end below said key mount, and wherein said first tang is inclined downwardly and wherein said second tang is inclined upwardly.

3. The shelving system of claim 1 wherein said clamping member includes a shaft and wherein said key mount has a vertical first bore therethrough and wherein said slide block has a vertical second bore therethrough, and wherein said first and second bores are vertically aligned when said key mount and said slide block are mounted on said base end of said each bracket arm, and wherein said shaft journals through said first and second bores.

4. The shelving system of claim 3 wherein said shaft is a threaded member.

5. The shelving system of claim 4 wherein said second bore is threaded and only a corresponding end of said threaded shaft is threaded for threaded mating into said second bore whereby rotation of said threaded shaft translates said slide block relative to said key mount and vertically along said base end.

6. The shelving system of claim 5 wherein said first and second keys are planar.

7. The shelving system of claim 6 wherein said first and second tangs are planar hooked tangs.

8. The shelving system of claim 7 wherein said threaded shaft is a bolt and said slide block has an elongate channel along its length for sliding mating with an end edge of said each bracket arm.

9. The shelving system of claim 1 wherein said adjustment means includes adjustment slots extending in said second direction in said underside of said shelf and wherein fasteners on said at least one slide slidably engage said adjustment slots.

10. The shelving system of claim 9 wherein said shelf includes supporting beams extending along said underside and wherein said adjustment slots are formed in said beams.

11. A method for mounting a shelving system comprising the steps of:

a) providing a pair of parallel, substantially vertical, laterally spaced apart shelving standards laterally spaced apart a first distance;

b) providing at least two pairs of vertically spaced apart keys releasably mated with the pair of standards, one vertically spaced apart pair of keys per standard c) providing a pair of rigid bracket arms mounted to the pairs of keys, each bracket arm of the pair of rigid bracket arms mounted to a corresponding pair of vertically spaced apart keys, wherein at least one of the keys in each pair is a slidable key slidably mounted to the end of the bracket arm adjacent the corresponding standard for vertical sliding relative to the bracket arm, d) providing manually extendable slides, mounted to the each bracket arm, translatable between a retracted position and an extended position cantilevered from the each bracket arm, e) providing a rigid substantially planar shelf mounted onto the slides, at opposite ends of the shelf, and so as to extend between the slides when the slides are mounted to the pair of rigid bracket arms, wherein the shelf has a first length measured from each end of the opposite ends, f) providing a threaded member for each pair of keys threadably mounted thereto for actuating vertical sliding of the slidable key along the end of the bracket arm, g) adjusting the vertical distance between each pair of keys, when mounted to the pair of rigid bracket arms, to correspond to the vertical spacing between vertical spaced and vertically aligned slots in the standard and adjusting the horizontal distance between the pair of slides and corresponding pair of mounting brackets to correspond to the first distance, h) inserting a pair of tangs corresponding to the pairs of keys into the corresponding slots in the standard and turning the threaded member so as to tighten the tangs in to snug mating engagement in the slots.

* * * * *